US005458335A

United States Patent [19]

Hattori

[11] Patent Number: 5,458,335

[45] Date of Patent: Oct. 17, 1995

[54] COMBINED PUTTER AND WEDGE GOLF CLUB

[76] Inventor: Noriyasu Hattori, 26916 Spring Creek Rd., Rancho Palos Verdes, Calif. 90274

[21] Appl. No.: 158,595

[22] Filed: Nov. 24, 1993

[51] Int. Cl.[6] ..... A63B 53/04

[52] U.S. Cl. ..... 273/168; 273/167 G

[58] Field of Search ..... 273/168, 167 R, 273/167 J, 78, 79, 167 A, 80 C, 167 G; D 21/217

[56] References Cited

U.S. PATENT DOCUMENTS

| | | | |
|---|---|---|---|
| D 180,257 | 5/1957 | Wetzel . | |
| 653,483 | 7/1900 | McCrea | 273/168 |
| 1,257,471 | 2/1918 | Fitzjohn et al. . | |
| 2,530,446 | 11/1950 | Beardsley . | |
| 2,962,286 | 11/1960 | Brouwer . | |
| 3,204,962 | 9/1965 | McCormick | 273/168 |
| 3,416,798 | 12/1968 | Pennington | 273/168 X |
| 3,515,389 | 6/1970 | Wolfe . | |
| 3,578,325 | 5/1971 | Teas . | |
| 4,123,056 | 10/1978 | Nakamatsu | 273/78 |
| 4,174,108 | 11/1979 | Reinholz | 273/168 X |
| 4,312,509 | 1/1982 | Grant | 273/167 A |
| 4,453,713 | 6/1984 | Guyer . | |
| 4,506,888 | 3/1985 | Nardozzi | 273/168 X |
| 4,512,583 | 4/1985 | de Vilmorin . | |
| 4,795,158 | 1/1989 | Kuykendall | 273/167 B |
| 4,878,666 | 11/1989 | Hosoda | 273/79 |
| 5,160,144 | 11/1992 | Maniatis | 273/78 |
| 5,176,379 | 1/1993 | Reinberg | 273/80 C |

FOREIGN PATENT DOCUMENTS

| | | | |
|---|---|---|---|
| 25564 | 12/1905 | United Kingdom | 273/167 J |
| 1432688 | 8/1973 | United Kingdom . | |
| 16148 | 9/1982 | United Kingdom | 273/168 |

*Primary Examiner*—Sebastiano Passaniti

*Attorney, Agent, or Firm*—Knobbe, Martens, Olson & Bear

[57] ABSTRACT

A golf club including a shaft connected to a club head having first leg with a putting face thereon and a second leg with a chipping or pitching surface thereon is disclosed. The shaft is rigidly mounted perpendicular to the club head and centrally along the length of the club head. The putting face is upright is substantially parallel to the shaft of the golf club and designed for use in putting a golf ball. The chipping face is angled or sloped relative to the shaft and is designed for use in chipping a golf ball.

16 Claims, 3 Drawing Sheets

COMBINED PUTTER AND WEDGE GOLF CLUB

FIELD OF THE INVENTION

The present invention relates in general to golf clubs and, more particularly, to a multi-purpose golf club.

BACKGROUND OF THE INVENTION

Golf clubs typically include a single shaft connected to a club head, with an end of the shaft forming a handle or grip used with the club head normally attached to an opposite end of the shaft. A conventional club head contains a single face or surface used to strike a golf ball. As is well known, the shape and angular relationship of the plane of the striking face to the ground causes the ball, when struck, to move in a desired motion. For example, the face of the club head may consist of an upright surface that is essentially perpendicular or 90 degrees to the ground. This type of golf club (called a "putter") is often used to putt the golf ball, as the angular relationship of the face to the ground causes the ball, when struck, to travel in linear motion along the ground. This type of club typically does not impart any loft to the ball which would cause the ball to leave the ground.

Other typical golf clubs have a club head containing a face that is at a different angle relative to the ground. These golf clubs cause the ball to be carried into the air, and are thus often used to chip or pitch the golf ball. Thus, different golf clubs with differently angled faces are used to strike a golf ball and cause the ball to travel in a desired motion.

Because each club head contains a differently angled club face, a person playing the game of golf must carry a plurality of golf clubs. A golfer selects from the plurality of clubs a particular club to use according to the desired shot to be played.

When the golf ball is near the green or putting surface, a golfer typically pitches or chips the golf ball onto the putting surface using a club head having a face with a sharp angle. The golfer then changes clubs and uses a putter when the ball is on the putting surface.

Quite frequently, it is desirable to have a single golf club that performs the functions of more than one club.

In fact, U.S. Pat. No. 2,530,446 discloses a combination golf club that can be used as both a putter and a jigger. The jigger contains an angled or sloped surface on one face of the club head that is used to chip or pitch the ball. The opposing face of the club head includes an upright surface that is used as a putter. The putter or jigger face is selected by removing a part of the club head that contains the two faces, rotating the part 180°, and then reinstalling the part with the faces reversed. The shaft is rigidly connected to one end of the center portion of the club head. The putter and jigger faces are removably attached to this center portion of the club head. This device has the disadvantage that a golfer has to remove and adjust the club head to select the different hitting surfaces. Thus, the golfer is repeatedly manipulating the club head to chip or putt the ball.

U.S. Pat. No. 1,257,471 discloses a golf club containing a solid club head with an angled or lofting surface and a driving surface. One face of the club head consists of a driving surface. The opposing face of the club head is the angled or lofting surface. The shaft of the golf club extends at an angle from one side of the club head. Because the shaft extends at an angle from one side of the club head, the lofting or angled face of the club head strikes a golf ball during a right-handed swinging motion. The driving face of the club strikes the ball during a left-handed swinging motion. This device has the particular disadvantage that completely different right and left-handed swinging motions must be used in order to strike the ball with different surfaces.

U.S. Design Pat. No. 180,257 discloses a golf club head containing both an angled or sloped surface on one face of the club head and an upright surface on the opposing face. Although it is unclear from the figures, it appears the shaft is adjustably connected to the club head. This adjustable connection would require continual adjustment of the shaft relative to the club head to chip or putt the ball. However, if the shaft is not adjustably connected to the club head, then a right-handed swinging motion is necessary to strike a ball with the angled surface while a left-handed swinging motion is required to strike the ball with the upright surface. Thus, this device has the disadvantages that repeated adjustment of the club head may be required or completely different swinging motions may be required to strike the ball with the different surfaces. Further, the club head consists of a solid body with an exposed screw on the bottom surface. This screw may indicate further adjustment or manipulation of the club head is required.

There remains a need for a single golf club which allows a golfer to chip or pitch the golf ball onto the green and then putt the ball without changing clubs. This dual function golf club would save time and effort because the golfer could chip the ball and then immediately putt the ball without the need, for example, of returning to the golf bag or golf cart to retrieve a different golf club.

It will be readily appreciated that a single golf club that allows both putting and chipping is very advantageous. For example, the purchase of a single club that performs both functions is more cost effective than purchasing separate clubs for each function. Additionally, a single multi-function club has less weight and is easier to carry than separate clubs. Further, a single club saves time because a golfer can immediately chip and then putt a golf ball without changing clubs. Thus, a dual function golf club is an inexpensive, efficient alternative to purchasing separate, individual clubs.

Therefore, there remains a need for a golf club that does not have the above-described significant disadvantages, but yet which allows, with a single club, the performance of both putting and chipping functions without adjustment or manipulation of the club head is desired. Additionally, a golf club that permits chipping and putting by either right or left-handed golfers is desired.

SUMMARY OF THE INVENTION

In order to overcome the above-stated problems and limitations, a golf club is provided which includes a shaft and a club head which includes both putting and chipping faces. One end of the shaft includes a grip or gripping means. The other end of the shaft is preferably rigidly mounted centrally along the length of the club head. The shaft preferably extends perpendicularly from a top surface of the club head.

In the preferred embodiment, the club head comprises a first upright "putting" leg and a second angled "chipping" leg connected at the top surface. The upright leg is essentially parallel to the shaft of the golf club and perpendicular to the ground and includes a putting face which is preferably used as a putting surface. The second leg of the golf club is angled or sloped relative to the first leg, and contains a chipping face thereon which is preferably used as a chipping surface. The putting and chipping faces preferably are located opposite one another. The chipping face preferably lies at an angle of about 45° with respect to the putting face.

The present invention allows a golfer to perform both putting and chipping functions while using the same club. The golfer chips the golf ball by swinging the second leg which is angled or sloped so that the chipping face of the club strikes the ball. The golfer uses the same club to putt the ball merely by rotating the entire club 180° about the shaft and then using the putting face to strike the ball. Thus, the golfer does not have to adjust or manipulate the golf club in order to either putt or chip the golf ball.

In particular, the present preferred embodiment permits both chipping and putting to be performed using the same swinging motion because the shaft is mounted centrally along the length of the club head and perpendicularly to the club head. Further, the fact that the shaft and club head are connected at a 90° angle permits either right- or left-handed golfers to use the golf club for both putting and chipping functions.

The present invention also provides a low cost, lightweight means of putting and chipping or pitching a golf ball. The present invention has a simple design which is inexpensive to manufacture, contains no movable parts, and is efficient in operation.

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of accompanying drawings in which:

DETAIL DESCRIPTION OF THE PREFERRED EMBODIMENT

Figure 1A:
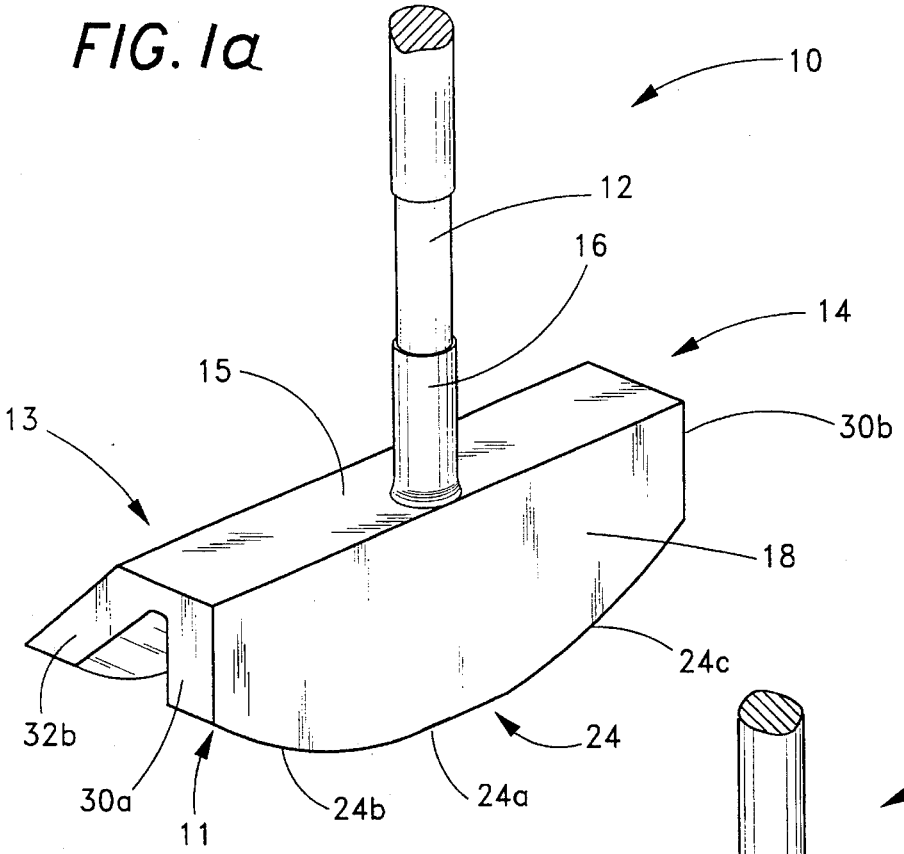
FIG. 1*a* is a front perspective view of the preferred embodiment of the present invention of the combined putter and wedge golf club illustrating the putting face.
Figure 1B:
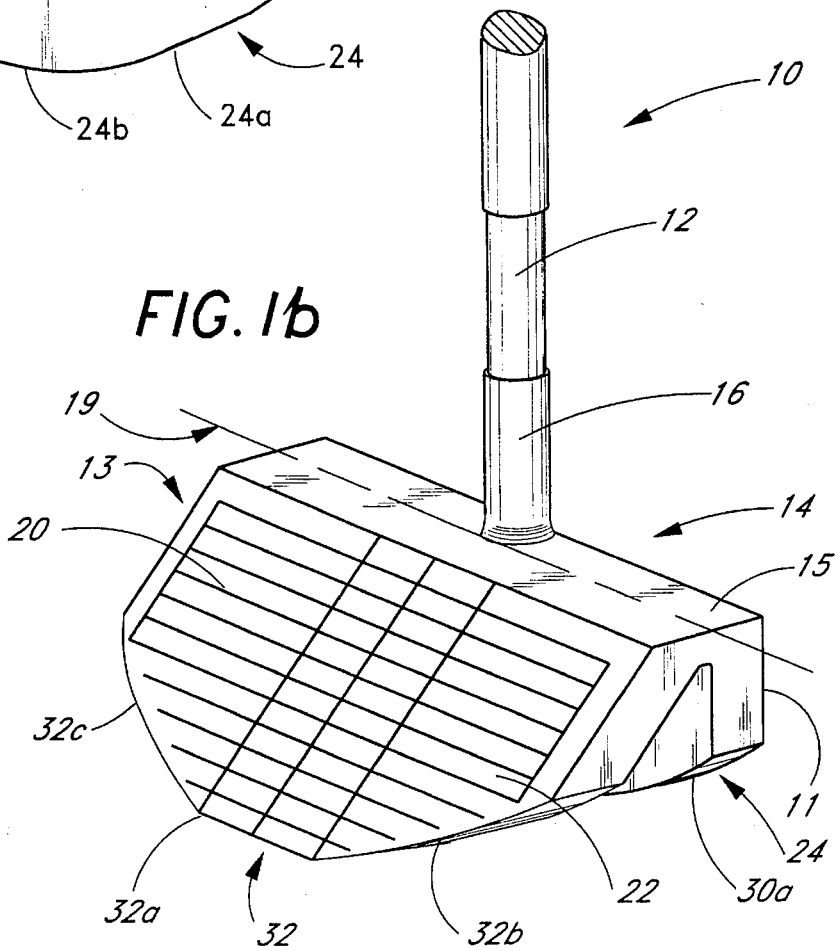
FIG. 1*b* is a front perspective view of the chipping face of the combined putter and wedge golf club of FIG. 1*a*.

As shown in FIGS. 1*a* and 1*b*, the combined putter and wedge or chip golf club is generally shown at 10. The golf club 10 includes a shaft 12 connected on one end to a club head 14. A second end of the shaft 12 (not shown) includes a handle or grip as is well known in the art.

Figure 6:
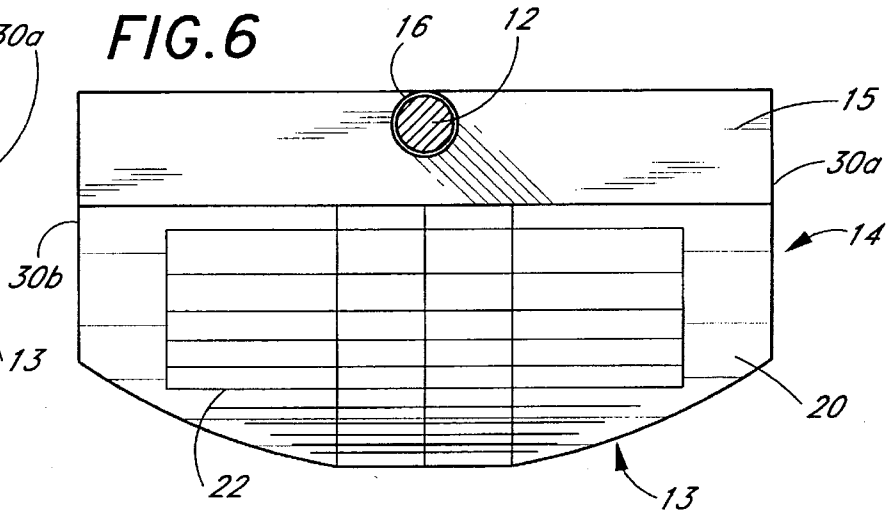
FIG. 6 is a top view of the combined putter and wedge golf club of FIG. 1*a*.

The head end of the shaft 12 is preferably centrally located along the length of the club head 14, and rigidly attached thereto. Further, the shaft 12 preferably extends perpendicularly from an upper surface 15 of the club head 14 (see FIG. 6). It is possible, though not preferred, for the shaft 12 to be connected in other than a perpendicular fashion. Further, the shaft 12 may be rotatably connected or otherwise not rigidly attached. The shaft 12 may be attached to the club head 14 in a variety of methods known to those skilled in the art. A preferred method is to telescopically insert and force-fit the shaft 12 into the club head 14. A hosel 16 may be used to cover or protect the connection or attachment of the shaft 12 to the club head 14.

Figure 3:
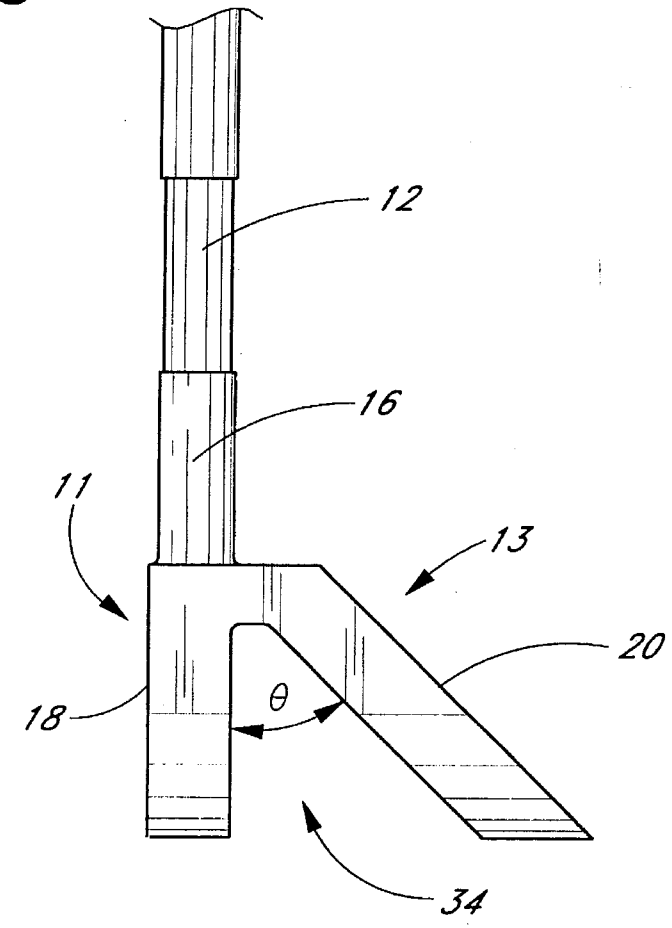
FIG. 3 is an end elevational view of the combined putter and wedge golf club of FIG. 1*a*.

The club 14, as illustrated in FIGS. 1*a* and 1*b*, comprises a first "putting" leg 11 and a second "chipping" leg 13 connected along the upper surface 15 of the club head 14. The putting leg 11 extends generally parallel to the shaft 12 (and thus perpendicular to a flat surface such as the ground), while the chipping leg 13 extends at an angle thereto. As best seen in FIG. 3, the result of the chipping leg 13 extending at an angle from the putting leg 11 is a cavity 34 between the two legs 11, 13. It is understood that the club head 14 can be made of a solid block of material with outer faces thereon.

The club head 14, including legs 11 and 13, is preferably made of a durable material, such as steel or aluminum, although can be made of numerous other materials known in the art. The legs 11 and 13 have a thickness which allows for a strength which allows for the striking of the ball without damage to the club head 14. As illustrated, the thickness of each leg is about equal to the diameter of the shaft. Each leg 11, 13 preferably has a width along a longitudinal axis 19 of the club head 14 of about 4 inches, although any width which allows for a striking face large enough to strike the ball is acceptable. The putting leg 11 preferably has a length that extends downwardly from the upper surface 15 of the club 14 by approximately 1 and ⅜ inches, although the distance may vary as long as the leg 11 allows for a surface large enough to strike the ball. The exact length of the chipping leg 13 is dependent upon the angle at which the leg 13 extends from the club head 14. In any case, however, the chipping leg 13 has a length such that the putting leg 11 and chipping leg 13 extend downwardly the same distance.

Figure 2:
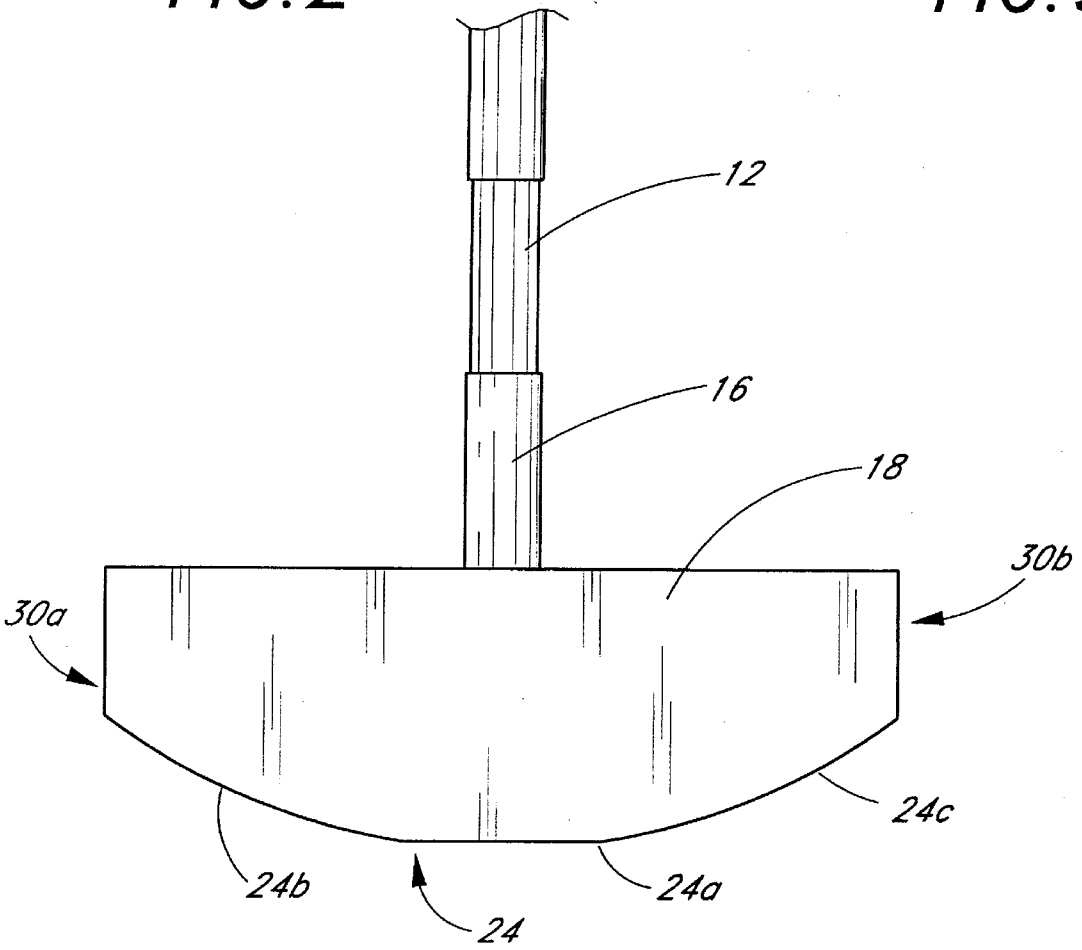
FIG. 2 is a front elevational view of the putting face of the combined putter and wedge golf club of FIG. 1*a*.
Figure 5:
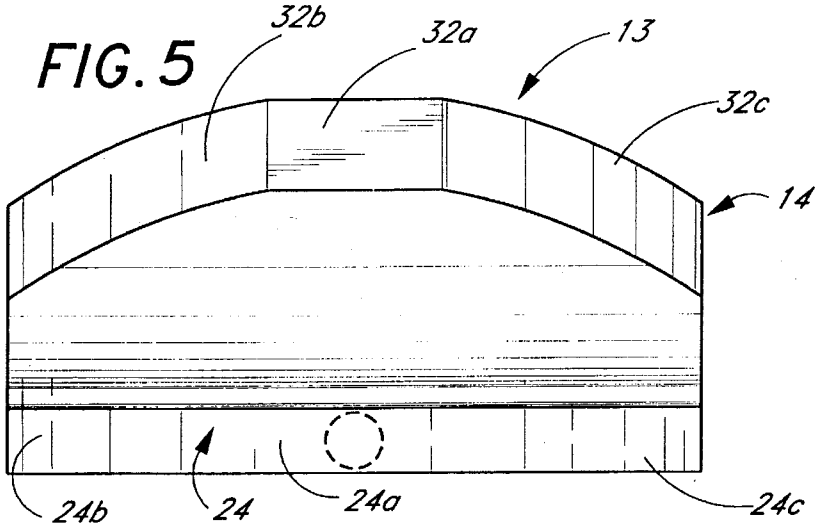
FIG. 5 is a bottom view of the combined putter and wedge golf club of FIG. 1*a*.

As can be seen in FIG. 2, the putting leg 11 includes a bottom surface 24. The bottom surface 24 preferably has a first section 24*a* centered along the length of surface 24 which is flat so as to allow the golf club 10 to rest on the ground before the putting motion is initiated. The bottom surface 24 of the putting leg 11 also includes angled or sloped surfaces 24*b* and 24*c*. The sloped surface 24*b* extends from the flat portion 24*a* of the bottom surface 24 to a side 30*a* of the club head 14. The sloped surface 24*c* extends from the flat portion 24*c* of the bottom surface 24 to a side 30*b* of the club head 14. Preferably, flat portion 24*a* extends approximately one-third of the length of bottom surface 24; angled or sloped surface 24*b* extends upwardly along the outer one-third of bottom surface 24 to side 30*a* of club head 14; and angled or sloped surface 24*c* similarly extends upwardly to side 30*b* of club head 14. Preferably, the bottom sloped surfaces 24*b,c* each met the respective sides 30*a,b* of the club head 14 about ½ to ⅔, and most preferably about ½ of the way between the top and bottom of the club head 14.

Figure 4:
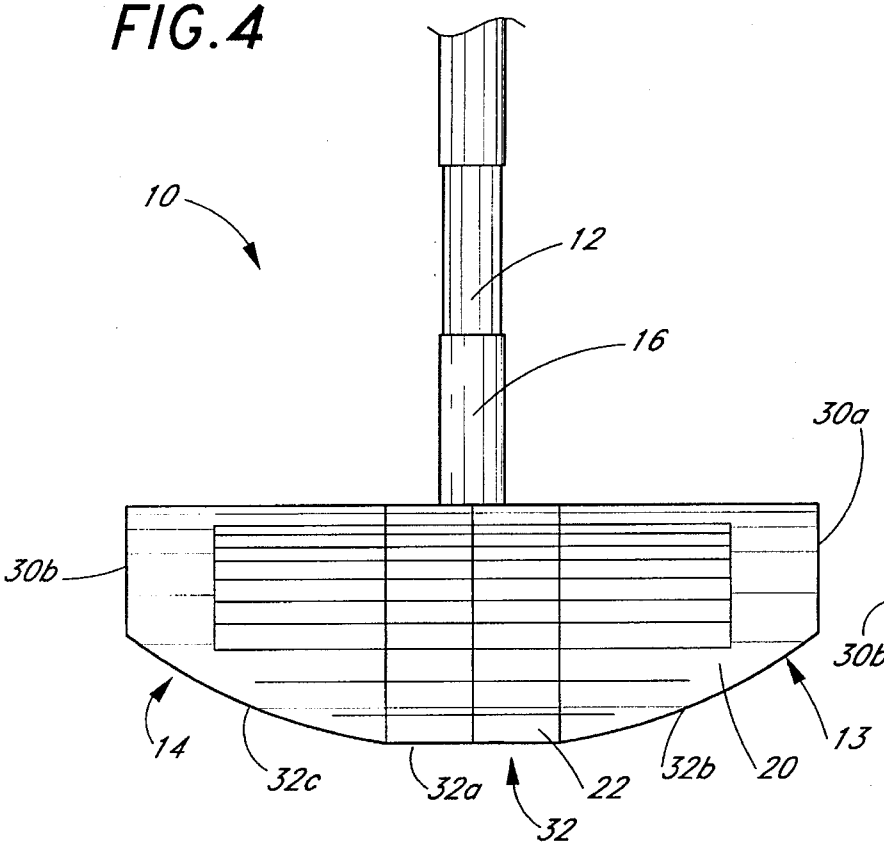
FIG. 4 is a front elevational view of the chipping face of the combined putter and wedge golf club of FIG. 1*a*.

As illustrated in FIG. 4, the chipping leg 13 also includes a bottom surface 32. Surface 32*a* of surface 32 is preferably flat and is centered along the length of surface 32. An angled or sloped surface 32*b* extends from the flat portion 32*a* of the bottom surface 32 to side 30*a* of the club head 14. The chipping leg 13 also includes an angled or sloped surface 32*c* extending from the flat portion 32*a* of the bottom surface 32 to side 30*b*. Preferably, flat portion 32*a* extends approximately one-third of the length of bottom surface 32; angled or sloped surface 32*b* extends upwardly along the outer one-third of bottom surface 32 to contact side 30*a* of the club head 14; and angled or sloped surface 32*c* extends upwardly from flat portion 32*a* to side 30*b*. Preferably, the bottom sloped surfaces 32*b,c* each meet the respective sides 30*a,b* of the club head 14 about ½ to ⅔, and most preferably about ½ of the way between the top and bottom of the club head 14.

The flat portions 24*a*, 32*a* of the bottom surfaces 24, 32 allow the club 10 to be placed on a flat surface and stand upright without assistance. The sloped or angled portions 24*b,c*, 32*b,c* of the bottom surfaces 24, 32 reduce the surface area of each leg 11, 13 which is proximate the ground during swinging of the club 10, thus lessening the friction between the club head 14 and the ground if the two contact during striking.

In addition, the bottom surface 24 of the chipping leg 11 is approximately parallel to the bottom surface 32 of the chipping leg 20. Further, angled or sloped surfaces 24*b* and 32*b*, and angled surfaces 24*c* and 32*c* preferably have approximately the same slope or angle.

As seen in FIG. 1*a*, a putting face 18 is located on the putting leg 11. The putting face 18 comprises the essentially upright outer surface of the leg 11 which is parallel to shaft 12, and which, when used, is generally perpendicular to a flat surface such as a putting green. The putting face 18 is preferably ground as smooth and flat as possible to provide a flat surface for striking the ball when putting.

As shown in FIG. 1*b*, opposite the putting face 18 of the club head 14 is a chipping face 20. The chipping face 20 comprises the outer surface of the leg 13, and thus lies in a plane which is at an angle relative to the shaft 12 and the putting face 18. Preferably, the chipping face 20 is angled with respect to the shaft 12 and leg 11 by an angle θ of 40° to 65° (see FIG. 3). Most preferably, the chipping face 20 lies at an angle of 45° with respect to the shaft 18. This may be accomplished by having the leg 13 extend from the upper surface 15 of the club head 14 at this angle, or the leg 13 may extend at a given angle and then the thickness of the leg 13 may be varied to achieve the desired angle of the chipping face 20.

Preferably, a plurality of grooves, lines or etches 22 are located on the chipping face 20. Grooves 22 are preferably used as such assist in imparting a spinning motion upon a golf ball when struck. These grooves 22 may have any of a variety of configurations. Preferably, however, at least a number of grooves run parallel to the longitudinal axis 19 of the club head 14. Further, a number of grooves, lines, or etches 22, may be located on or in the chipping face 20 and run perpendicular to the longitudinal axis 14 of the club head 14 for adding traction and/or to aid in aligning the club head 14 with the center of the striking surface.

It will be readily understood that the components of the present invention, as generally described and illustrated in the figures herein, could be arranged and designed in a wide variety of different configurations. Thus, the embodiment of the invention, as represented in FIGS. 1 through 6, is not intended to limit the scope of the invention, as claimed, but it is merely representative of the presently preferred embodiment of the invention.

I claim:

1. A golf club which permits both chipping and putting by a golfer, comprising:

a club head having only two faces including a putting face and a chipping face;

a longitudinal axis extending between said putting face and said chipping face, said putting face and said chipping face intersecting to form a line parallel to said longitudinal axis; and a shaft having an end rigidly connected to said club head, said shaft extending from said club head perpendicular to the longitudinal axis thereof and said shaft being substantially parallel to said putting face.

2. The golf club of claim 1, wherein said shaft is mounted centrally along a length of said club head which lies along the longitudinal axis.

3. A golf club which permits both chipping and putting by a golfer, comprising:

a club head having a longitudinal axis and only two faces including a putting face and a chipping face, said club head comprises a putting leg and a chipping leg joined at a top surface;

a shaft having an end rigidly connected to said club head, said shaft extending from said club head perpendicular to the longitudinal axis thereof and said shaft being substantially parallel to said putting face.

4. The golf club of claim 3, wherein said putting face is located on said putting leg and said chipping face is located on said chipping leg.

5. The golf club of claim 4, wherein said chipping face has a plurality of grooves located thereon.

6. The golf club of claim 5, wherein one or more of said plurality of grooves run perpendicular to said longitudinal axis of the club.

7. A golf club which permits either chipping or putting by a golfer, comprising:

a club head having only two legs including a putting leg and a chipping leg, said putting leg being rigidly connected to said club head, said chipping leg being rigidly connected to said club head, a putting face located on said putting leg and a chipping face located on said chipping leg; and a shaft having a first end for gripping and a second end rigidly and nonrotatably connected to said club head and said shaft being substantially parallel to said putting face.

8. The golf club of claim 7, wherein said chipping leg extends from said club head at an angle with respect to a flat surface, said flat surface extends between said putting leg and said chipping leg.

9. The golf club of claim 7, wherein said putting leg extends from said club head at an angle perpendicular to a flat surface, said flat surface extends between said putting leg and said chipping leg.

10. The golf club of claim 7, wherein said putting leg lies in a plane perpendicular to a flat surface, said flat surface extends between said putting leg and said chipping leg, and wherein said chipping leg extends at an angle of 45 degrees from said plane containing said putting leg.

11. A golf club which permits either chipping or putting by a golfer, comprising:

a club head having only two legs including a putting leg and a chipping leg, a putting face located on said putting leg and a chipping face located on said chipping leg; and a shaft having a first end for gripping and a second end connected to said club head, said shaft being substantially parallel to said putting face, said shaft being rigidly and nonrotatably attached to said club head and extending therefrom at an angle perpendicular to a longitudinal axis of said club head.

12. The golf club of claim 7, wherein said club head includes a first end and a second end, and wherein each of said legs includes a bottom surface, said bottom surface having a flat portion, a first curved portion extending from said flat portion to said first end, and a second curved portion extending from said flat portion to said second end.

13. A method of putting and chipping a golf ball with only two faces including a single golf club having a club head with a putting face and a chipping face and a shaft nonadjustably and perpendicularly connected to said club head for swinging said golf club, comprising:

gripping the shaft of said golf club;

aligning the chipping face of said club with a ball;

swinging said club to chip said ball;

rotating said club 180°;

gripping the shaft of said golf club;

aligning the putting face of said club with a ball;

swinging said club to putt said ball.

14. A golf club which permits both chipping and putting by a golfer, comprising:

a club head having a first surface and an opposing second surface;

said club head having only two faces including a putting face being located on said first surface and a chipping face being located on said second surface;

a longitudinal axis extending between said putting face and said chipping face, said putting face and said chipping face intersecting to form a line parallel to said longitudinal axis; and a shaft having an end nonadjustably connected to said club head, said shaft extending perpendicular to the longitudinal axis of said club head, said shaft being substantially parallel to said putting face such that the putting face is substantially perpendicular with respect to the ground and the chipping face is at an angle greater than 90 degrees with respect to the ground.

15. The golf club of claim 14, wherein said shaft is mounted centrally along the length of the club head which lies along the longitudinal axis.

16. The golf club of claim 14, wherein said first surface is in a first plane, said second surface is in a second plane, and said first plane and second plane intersect at an angle of about 45 degrees.

* * * * *